US009392645B2

(12) United States Patent
Mikkelsen et al.

(10) Patent No.: US 9,392,645 B2
(45) Date of Patent: Jul. 12, 2016

(54) POSITIVE TEMPERATURE COEFFICIENT HEATING ELEMENTS AND THEIR MANUFACTURING

(75) Inventors: Erik Mikkelsen, Hallstahammar (SE); Martin Öhman, Stockholm (SE); Joachim Sjöstrand, Solna (SE); Shirzad Kalhori, Kista (SE)

(73) Assignee: Conflux AB, Järfälla (SE)

( * ) Notice: Subject to any disclaimer, the term of this patent is extended or adjusted under 35 U.S.C. 154(b) by 868 days.

(21) Appl. No.: 13/498,591

(22) PCT Filed: Sep. 23, 2010

(86) PCT No.: PCT/SE2010/051027

§ 371 (c)(1),
(2), (4) Date: Mar. 28, 2012

(87) PCT Pub. No.: WO2011/040865

PCT Pub. Date: Apr. 7, 2011

(65) Prior Publication Data

US 2012/0175362 A1 Jul. 12, 2012

(30) Foreign Application Priority Data

Sep. 29, 2009 (SE) ..... 0950708

(51) Int. Cl.
*H05B 3/10* (2006.01)
*H05B 3/34* (2006.01)
(Continued)

(52) U.S. Cl.
CPC ..... *H05B 3/34* (2013.01); *H01C 7/021* (2013.01); *H01C 7/027* (2013.01); *H01C 17/07* (2013.01);
(Continued)

(58) Field of Classification Search
CPC ..... H01C 17/07; H01C 7/021; H01C 7/027; H05B 2203/006; H05B 2203/017; H05B 2203/02; H05B 3/34
USPC ..... 219/200, 482, 490, 504, 505, 510, 511, 219/528, 538, 540, 542, 544, 548, 553; 338/13, 20, 22 R; 392/502; 29/610.1, 29/611, 612
See application file for complete search history.

(56) References Cited

U.S. PATENT DOCUMENTS 4,696,764 A 9/1987 Yamazaki
6,462,643 B1 10/2002 Fujii et al.
(Continued)

FOREIGN PATENT DOCUMENTS

CN 1529329 * 9/2004
CN 1529329 A 9/2004
(Continued)

OTHER PUBLICATIONS

Chinese Office Action and Search Report Corresponding to Chinese Patent Application No. 201080042107.2; Dated: Jun. 6, 2013; 4 Pages.

*Primary Examiner* — Dana Ross
*Assistant Examiner* — Joseph Iskra
(74) *Attorney, Agent, or Firm* — Myers Bigel & Sibley, P.A.

(57) ABSTRACT

A method of manufacturing semi-manufactured PTC heating elements (10) comprises the steps of providing an electrically insulating support foil (11), providing an electrically conductive foil (12) from which at least two electrically conductive patterns separated from one another are to be formed, and laminating a PTC compound (13) between the electrically insulating support foil and the electrically conductive foil, wherein the PTC compound has adhesive properties for bonding the laminate together. Preferably, the electrically insulating support foil, the electrically conductive foil, and the semi-manufactured PTC heating elements are provided on rolls. PTC heating elements are manufactured by means of cutting the semi-manufactured PTC heating elements into suitable pieces, patterning and etching the electrically conductive patterns, and attaching electrically conductive terminals to the electrically conductive patterns.

16 Claims, 2 Drawing Sheets

(51) Int. Cl.
*H01C 7/02* (2006.01)
*H01C 17/07* (2006.01)

(52) U.S. Cl.
CPC ..... *H05B 2203/006* (2013.01); *H05B 2203/017* (2013.01); *H05B 2203/02* (2013.01); *Y10T 29/49083* (2015.01)

(56) References Cited

U.S. PATENT DOCUMENTS 7,049,559 B2 5/2006 Ishii et al.
7,270,776 B2 9/2007 Mori et al.
2010/0320191 A1 * 12/2010 Von Wachenfeldt et al. . 219/548

FOREIGN PATENT DOCUMENTS

| | | | |
|---|---|---|---|
| CN | 101335124 | * | 12/2008 |
| CN | 101335124 | A | 12/2008 |
| CN | 101521963 | A | 9/2009 |
| CN | 101523975 | A | 9/2009 |
| EP | 1653778 | A1 | 5/2006 |
| WO | WO 2008/048176 | | 4/2008 |

* cited by examiner

POSITIVE TEMPERATURE COEFFICIENT HEATING ELEMENTS AND THEIR MANUFACTURING

RELATED APPLICATIONS

This application is a 35 U.S.C. §371 national phase application of PCT Application PCT/SE2010/051027, filed Sep. 23, 2010, which claims priority to SE 0950708-8, filed Sep. 29, 2009. The entire content of each of these applications is incorporated herein by reference.

TECHNICAL FIELD OF THE INVENTION

The present invention generally relates to positive temperature coefficient (PTC) heating elements and their manufacturing.

DESCRIPTION OF RELATED ART AND BACKGROUND OF THE INVENTION

U.S. Pat. No. 7,049,559 discloses a PTC heating element including a substrate, electrodes, a PTC resistor, and cover material. The substrate is made of ceramics, insulated metal plate, or polyester film. The electrodes are formed on the substrate by printing and drying a conductive paste. The PTC resistor is formed on top of the electrodes by printing and drying a PTC composition ink. The substrate, the electrodes, the PTC resistor and the cover material are bonded by way of polyethylene hot melting resin.

SUMMARY OF THE INVENTION

The manufacturing technique disclosed above seems not to be suited for the manufacturing of large number of products since it is complex and costly.

Further, PTC heating elements of different sizes and structure have to be held on stock, which is costly, or tailored PTC heating elements are manufactured on request, which is time consuming.

Yet further, the prior art manufacturing technique seems to be inflexible: larger area PTC heating elements and PTC heating elements with thicker PTC resistors will be difficult to manufacture.

It is therefore an object of the present invention to provide methods of manufacturing PTC heating elements which address the above shortcomings of the prior art technique.

It is a particular object of the invention to provide such methods which are simple, inexpensive, flexible, and well suited for manufacturing large number of products.

It is a further object of the invention to provide such methods, which are accurate, precise, reliable, and robust.

These objects among others are, according to the present invention, attained by the methods claimed in the appended patent claims.

According to a first aspect of the invention there is provided a method of manufacturing semi-manufactured PTC heating elements. According to the method, an electrically insulating support foil, preferably made of a polymer such as polyester or polyimide, and an electrically conductive foil, preferably a metal foil such as a copper foil, are provided. At least two electrically conductive patterns separated from one another are intended to be formed from the electrically conductive foil during completion of the manufacturing of the PTC heating elements. A PTC compound, preferably comprising an electrically insulating amorphous polymer with electrically conductive particles of PTC type dispersed therein, is laminated between the support foil and the conductive foil, wherein the PTC compound advantageously has adhesive properties for bonding the laminate together. Advantageously, the support foil and the conductive foil are provided on rolls, and the semi-manufactured PTC heating elements are supplied on roll.

By prefabricating semi-manufactured PTC heating elements according to the above described method a number of advantages are obtained. The manufacturing technique is fast, simple, and inexpensive. The semi-manufactures are very flexible since they can be used for a large variety of PTC heating element designs and applications. Only a single type of pre-manufactured PTC heating elements is required to be held on stock. Large area PTC heating element designs are capable of being manufactured from the pre-manufactured PTC heating elements. The maximum width of the PTC heating elements is set by the width of the rolls of the support foil and the conductive foil, which may be half a meter or larger, e.g. one or several meters. The maximum length of the PTC heating elements is only set by the length of the rolls of the support foil and the conductive foil.

In one embodiment of the invention, the lamination is performed by means of feeding the support foil and the conductive foil between rolls or cylinders while the PTC compound is supplied between the support foil and the conductive foil.

Hereby, the PTC compound can be formed to an evenly thick layer with a selected thickness which is controlled by the distance between the rolls or cylinders where the lamination is formed. The selected thickness may be between 10 and 10000 microns.

In a further embodiment of the invention the PTC compound comprises material which is curable (crosslinked), preferably in response to being irradiated.

According to a second aspect of the invention there is provided a method of manufacturing PTC heating elements which starts from the semi-manufactured PTC heating elements provided by the method according to the first aspect of the invention. The semi-manufactured PTC heating elements are cut into suitable sizes, the conductive foil of each of the cut semi-manufactured PTC heating elements is patterned and etched to form the conductive patterns separated from one another, and electrically conductive terminals are attached to the conductive patterns of each of the cut semi-manufactured PTC heating elements. Finally, a protection layer may be formed on top of the conductive patterns and on exposed portions of the PTC compound of each of the cut semi-manufactured PTC heating elements.

This method of manufacturing PTC heating elements is fast, simple, and inexpensive. Customized PTC heating elements may be manufactured fastly on request. Different sizes and kinds of PTC heating elements can be manufactured from a single laminate roll of semi-manufactured PTC heating elements.

Still further objects of the invention are to provide pre-manufactured PTC heating elements and a PTC heating element which are easy to use for custom designed heating geometries.

These objects are attained by the pre-manufactured PTC heating elements and the PTC heating element claimed in the appended patent claims.

Further characteristics of the invention, and advantages thereof, will be evident from the following detailed description of preferred embodiments of the present invention given hereinafter and the accompanying FIGS. 1-4, which are given by way of illustration only, and are thus not limitative of the present invention.

DETAILED DESCRIPTION OF EMBODIMENTS

Figure 1:
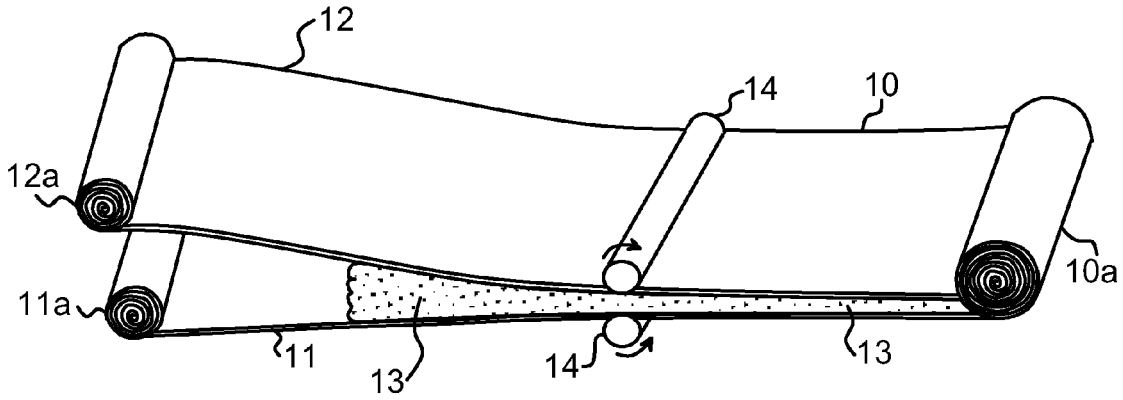
FIG. 1 displays schematically in a perspective view semi-manufactured PTC heating elements during manufacturing according to one embodiment of the invention.

FIG. 1 displays schematically semi-manufactured PTC heating elements 10 during manufacturing according to one embodiment of the invention. An electrically insulating support foil 11 and an electrically conductive foil 12 are provided, preferably on rolls 11*a*, 12*a*. The conductive foil 12 will later be used for forming at least two electrically conductive patterns separated from one another.

Typically, the support foil 11 is a polymer foil, preferably a polyester foil or a polyimide foil such as a kapton foil which remains stable in a wide range of temperatures, and the conductive foil 12 is a metal foil, preferably a copper foil. The polymer foil 11 is a flexible foil with a thickness of about 10-300 microns and the metal foil is a thin foil with a thickness of about 5-100 microns.

A PTC compound 13 having adhesive properties is provided. Preferably, the PTC compound comprises an electrically insulating amorphous polymer with electrically conductive particles of PTC type dispersed therein such as amorphous polymer based on siloxane elastomer (often called silicone elastomer) such as polydimethylsiloxane (PDMS) with carbon blacks of PTC type, and optionally carbon blacks of constant temperature coefficient (CTC) type, dispersed therein, as being described in WO 2008/048176, the contents of which being hereby incorporated by reference. The PTC compound 13 may optionally comprise a filler such as silica and a coupling agent such as a linear siloxane oligomer. Further examples of suitable PTC compound compositions are found in the above mentioned WO 2008/048176.

The PTC compound 13 is laminated between the support foil 11 and the conductive foil 12 by means of feeding the support foil 11 and the conductive foil 12 between rolls 14 while the rolls 11*a*, 12*a* of the support foil 11 and the conductive foil 12 are unrolled and the PTC compound 13 is supplied between the support foil 11 and the conductive foil 12 as schematically indicated in FIG. 1. The adhesive properties of the PTC compound 13 provide adhesive forces for bonding the laminate together, and as a result semi-manufactured PTC heating elements are provided as a long three layer only laminate. The three layer laminate is referred to as a ZPI (zero resistance, positive resistance, insulator).

Preferably, the semi-manufactured PTC heating elements 10 are supplied on roll 10*a*. In such manner a very long laminate can easily be stored and transported.

Figure 2:
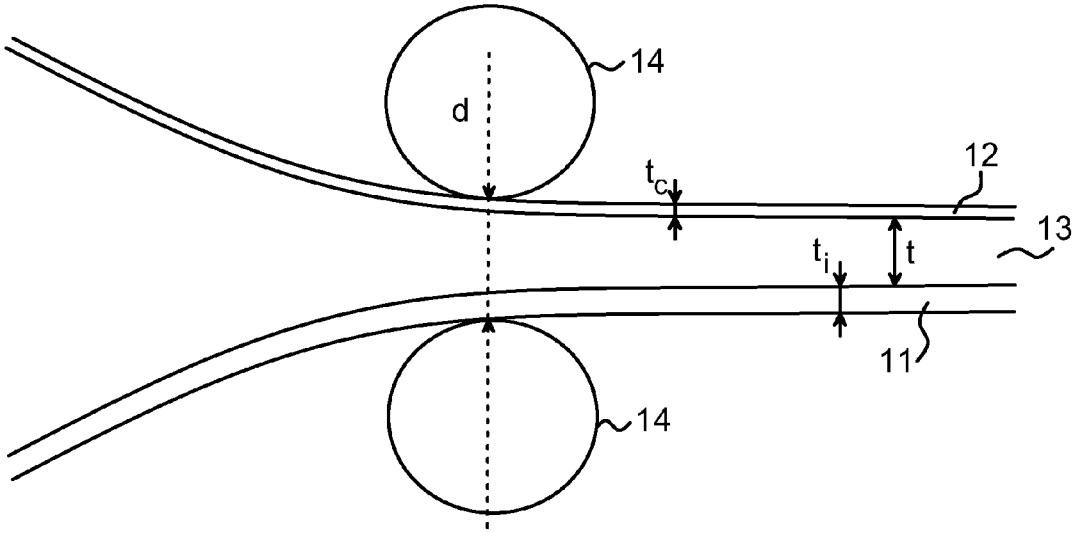
FIG. 2 displays schematically in an enlarged cross-sectional side elevation view of the semi-manufactured PTC heating elements of FIG. 1.

FIG. 2 displays schematically in an enlarged cross-sectional side elevation view the semi-manufactured PTC heating elements of FIG. 1. During the lamination the PTC compound 13 is formed to an evenly thick layer with a selected thickness t by means of controlling the distance d between the rolls 14 since the distance d is related to the thickness t of the PTC compound 13 according to $$d=t+t_i+t_c$$

where $t_i$ is the thickness of the insulating support foil 11 and $t_c$ is the thickness of the conductive foil 12. Depending on the particular application the thickness t is selected to be between 10 and 10000 microns.

After the lamination the three layer only laminate may be further processed such as e.g. heat treated.

In one embodiment the PTC compound 13 comprises material which is curable (crosslinked), preferably in response to being irradiated. An example of such a PTC compound is a compound comprising PDMS (polydimethylsiloxane), a medium size carbon black, a fast extrusion carbon black, silica, and a coupling agent.

Curing of the PTC compound 13 will give a nearly completely crosslinked and stable silicone matrix.

The prefabricated semi-manufactured PTC heating elements supplied on roll may be marketed and sold. The further manufacturing of PTC heating elements may be made at a later instant, at another place, and/or by another party. The semi-manufactures of the present invention can be used for a large variety of PTC heating elements for a large number of applications.

The process for manufacturing PTC heating elements from the semi-manufactured PTC heating elements 10 according to one embodiment of the invention will shortly be described with reference to FIGS. 3 and 4 which display schematically a PTC heating element during manufacturing and the PTC heating element after completion of the manufacturing process.

The semi-manufactured PTC heating elements 10 are cut into suitable sizes for the particular application. The conductive foil 12 of each of the cut semi-manufactured PTC heating elements 10 is patterned and etched to form at least two suitable electrically conductive patterns 16 separated from one another as can be seen in FIG. 3 for one of the PTC heating elements. Electrically conductive terminals 17 are attached and connected to the electrically conductive patterns 16 of each of the cut semi-manufactured PTC heating elements 10 and optionally a protection layer 18 is formed on top of the electrically conductive patterns 16 and on exposed portions of the PTC compound 13 of each of the cut semi-manufactured PTC heating elements 10, as can be seen in FIG. 4 for one of the PTC heating elements.

During use a current is arranged to flow between the conductive patterns 16 and in the PTC compound 13 below the conductive patterns 16 of a PTC heating element wherein heat is generated. The PTC compound 13 is conducting below a trip temperature, but above the trip temperature the resistance in the PTC compound 13 increases exponentially and as a result the current as well as the heat generation in the PTC compound 13 decreases rapidly.

Figure 3:
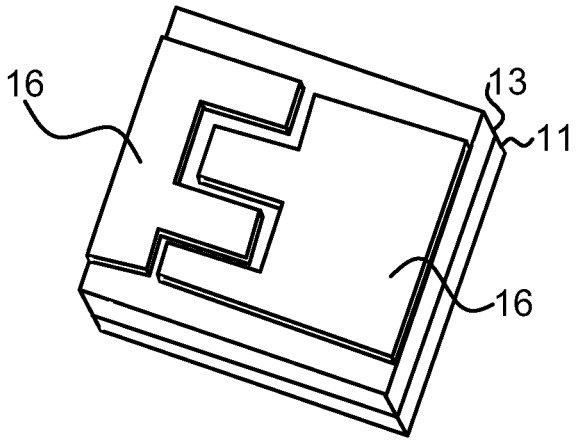
FIG. 3 displays schematically in a perspective view a PTC heating element during manufacturing according to one embodiment of the invention.
Figure 4:
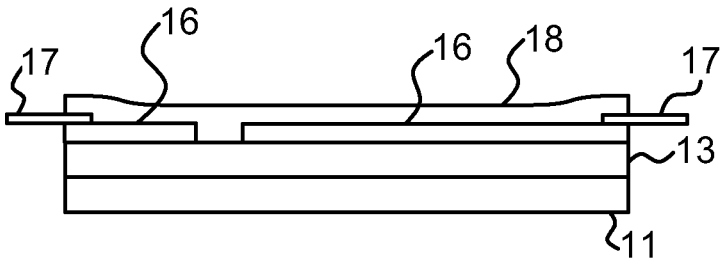
FIG. 4 displays schematically in a cross-sectional side elevation view the PTC heating element of FIG. 3 after completion of the manufacturing process.

It shall be appreciated that the conductive patterns 16 shown in FIG. 3 are strongly simplified for illustrating purposes. Depending on the particular application, the conductive patterns 16 may have different and much more complex structures. If more than two conductive patterns are formed, at least one electrically conductive terminal is attached and connected to each of the conductive patterns.

A selectable heat generation distribution can be achieved in the PTC compound 13 by providing suitable conductive patterns 16. The local heat generation depends on the local separation distance between the conductive patterns 16. By having different separation distances between the conductive patterns 16 at different portions of the conductive patterns 16 the resistances are different at different portions of the PTC compound 13 when the PTC heating element is switched on and as a result the current spike will be smaller and the load on the current source used will be smaller.

Further, the electric breakdown depends on the separation distance between the conductive patterns 16 and not on the thickness of the PTC compound.

The invention claimed is:

1. A method of manufacturing semi-manufactured PTC heating elements (10) comprising a three-layer only laminate of an electrically insulating support foil (11), an electrically conductive foil (12), and a layer of a PTC compound (13) sandwiched between and directly contacting the electrically insulating support foil and the electrically conductive foil, the method comprising the steps of:

providing the electrically insulating support foil (11) which is a polymer foil;

providing the electrically conductive foil (12) from which at least two electrically conductive patterns separated from one another are to be formed; and laminating the PTC compound (13) between the electrically insulating support foil and the electrically conductive foil, wherein the PTC compound has adhesive properties for bonding the laminate together;

wherein the step of laminating is performed by means of feeding the electrically insulating support foil and the electrically conductive foil between rolls (14) while the PTC compound is supplied between the electrically insulating support foil and the electrically conductive foil; and wherein the PTC compound is formed to an evenly thick layer with a selected thickness (t) by means of controlling the distance (d) between the rolls.

2. The method of claim 1 wherein said electrically conductive foil is a metal foil.

3. The method of claim 1 wherein said PTC compound comprises an electrically insulating amorphous polymer with electrically conductive particles of PTC type dispersed therein.

4. The method of claim 1 wherein the selected thickness is between 10 and 10000 microns.

5. The method of claim 1 wherein the electrically insulating support foil and the electrically conductive foil are provided on rolls (11*a*, 12*a*); and the rolls of electrically insulating support foil and electrically conductive foil are unrolled during the step of laminating.

6. The method of claim 1 wherein the PTC compound comprises material which is curable in response to being irradiated, and the PTC compound is cured subsequent to the step of laminating.

7. The method of claim 1 wherein the semi-manufactured PTC heating elements are supplied on roll (10*a*).

8. A method of manufacturing PTC heating elements comprising the method of claim 1 wherein the semi-manufactured PTC heating elements (10) are cut into suitable sizes;

the electrically conductive foil of each of the cut semi-manufactured PTC heating elements is patterned and etched to form at least two electrically conductive patterns (16) separated from one another; and electrically conductive terminals (17) are attached to the electrically conductive patterns of each of the cut semi-manufactured PTC heating elements.

9. The method of claim 8 wherein a protection layer (18) is formed on top of the electrically conductive patterns and on exposed portions of the PTC compound of each of the cut semi-manufactured PTC heating elements.

10. Semi-manufactured PTC heating elements (10) comprising a three-layer only laminate of an electrically insulating support foil (11) which is a polymer foil, an electrically conductive foil (12), and a layer of a PTC compound (13) sandwiched between and directly contacting the electrically insulating support foil and the electrically conductive foil, wherein the PTC compound has adhesive properties for bonding the laminate together.

11. The semi-manufactured PTC heating elements of claim 10 wherein the semi-manufactured PTC heating elements are provided on roll (10*a*).

12. A PTC heating element comprising a laminate of an electrically insulating support foil (11) which is a polymer foil, two electrically conductive patterns (16) separated from one another, and a layer of a PTC compound (13) sandwiched between and directly contacting the electrically insulating support foil and the electrically conductive patterns, wherein the PTC compound has adhesive properties for bonding the laminate together and the electrically conductive patterns are patterned and etched from an electrically conducting foil (12) and are provided with electrically conductive terminals (17).

13. The method of claim 1 wherein said electrically insulating support foil is a polyester foil.

14. The method of claim 1 wherein said electrically insulating support foil is a polyimide foil.

15. The method of claim 2 wherein said electrically conductive foil is a copper foil.

16. The method of claim 1 wherein the PTC compound comprises material which is curable in response to being irradiated, and the PTC compound is cured subsequent to the step of laminating, in response to being irradiated.

* * * * *